US009099787B2

(12) United States Patent
Blech

(10) Patent No.: US 9,099,787 B2
(45) Date of Patent: Aug. 4, 2015

(54) MICROWAVE ANTENNA INCLUDING AN ANTENNA ARRAY INCLUDING A PLURALITY OF ANTENNA ELEMENTS

(71) Applicant: Sony Corporation, Tokyo (JP)

(72) Inventor: Marcel Blech, Herrenberg (DE)

(73) Assignee: Sony Corporation, Tokyo (JP)

( * ) Notice: Subject to any disclaimer, the term of this patent is extended or adjusted under 35 U.S.C. 154(b) by 242 days.

(21) Appl. No.: 13/706,853

(22) Filed: Dec. 6, 2012

(65) Prior Publication Data

US 2013/0234904 A1 Sep. 12, 2013

(30) Foreign Application Priority Data

Dec. 21, 2011 (EP) ..... 11194773

(51) Int. Cl.

| | |
|---|---|
| ***H01Q 13/06*** | (2006.01) |
| ***H01Q 21/00*** | (2006.01) |
| ***H01Q 21/06*** | (2006.01) |
| ***H01Q 25/00*** | (2006.01) |

(52) U.S. Cl.

CPC ..... *H01Q 13/06* (2013.01); *H01Q 21/0081* (2013.01); *H01Q 21/061* (2013.01); *H01Q 25/00* (2013.01)

(58) Field of Classification Search

CPC ..... H01Q 13/06; H01Q 25/00; H01Q 21/061; H01Q 21/0086

USPC ..... 343/776, 786, 772

See application file for complete search history.

(56) References Cited

U.S. PATENT DOCUMENTS

| | | | | |
|---|---|---|---|---|
| 4,158,183 | A | 6/1979 | Wong et al. | |
| 4,761,625 | A * | 8/1988 | Sharma | 333/209 |
| 5,304,999 | A | 4/1994 | Roberts et al. | |
| 6,861,997 | B2 * | 3/2005 | Mahon | 343/772 |
| 7,026,869 | B2 | 4/2006 | Merenda et al. | |
| 2008/0129594 | A1 | 6/2008 | Pera et al. | |
| 2011/0063053 | A1 * | 3/2011 | Guler | 333/21 R |

OTHER PUBLICATIONS

U.S. Appl. No. 13/708,233, filed Dec. 7, 2012, Blech.

(Continued)

*Primary Examiner* — Hoanganh Le

(74) *Attorney, Agent, or Firm* — Oblon, McClelland, Maier & Neustadt, L.L.P.

(57) ABSTRACT

A microwave antenna comprises an antenna array comprising a plurality of antenna elements. An antenna element comprises a cover, a hollow waveguide formed within the cover for guiding microwave radiation at an operating frequency between a first open end portion and a second end portion arranged opposite the first end portion, a septum arranged centrally and along the longitudinal direction within the waveguide and separating said waveguide into two waveguide portions, a substrate arrangement arranged at the second end portion within the cover, said substrate arrangement comprising a ground plane and line structures arranged on both sides of and at a distance from said ground plane and a substrate integrated waveguide, a waveguide transition arranged between said hollow waveguide and said substrate integrated waveguide, an integrated circuit arranged within said cover and electrically contacted to said ground plane and said line structures, and terminals electrically contacted to said integrated circuit.

13 Claims, 5 Drawing Sheets

(56) References Cited

OTHER PUBLICATIONS

Paul Wade, "Enhancing the OK1DFC Square Septum Feed With a Choke Ring or Chaparral-style Horn and a Comparison of some Septum Polarizers", http://www.w1ghz/org/antbook/conf/Enhanced_Septum_Feed_MUD07.pdf, Aug. 27, 2007, 37 Pages.
Wenhua Chen et al., "Design of Compact Dual-Polarized Antennas for MIMO Handsets", International Journal of Antennas and Propagation, vol. 2012, Article ID 954742, pp. 1-8.
Sherif Sayed Ahmed et al., "Near Field mm-Wave Imaging with Multistatic Sparse 2D-Arrays", Proceedings of the 6$^{th}$ European Radar Conference, Rome, Italy, Sep. 2009, pp. 180-183.
Xiaodong Zhuge et al., "Near-Field Ultra-Wideband Imaging with Two-Dimensional Sparse MIMO Array", Proceedings of the 4$^{th}$ European Conference on Antennas and Propagation 2010, Barcelona, Spain, Apr. 2010, pp. 1-4.
Robert W. Jackson, "A Planar Orthomode Transducer", IEEE Microwave and Wireless Components Letters, vol. 11, No. 12, Dec. 2001, pp. 483-485.
G. Engargiola et al., "Tests of a planar *L*-band orthomode transducer in circular waveguide", Review of Scientific Instruments, vol. 74, No. 3, Mar. 2003, 4 Pages.
Roger Behe et al., "Compact Duplexer-Polarizer with Semicircular Waveguide", IEEE Transactions on Antennas and Propagation, vol. 39, No. 8, Aug. 1991, pp. 1222-1224.
Yunchi Zhang et al., "A Waveguide to Microstrip Inline Transition With Very Simple Modular Assembly", IEEE Microwave and Wireless Components Letters, vol. 20, No. 9, Sep. 2010, pp. 480-482.
U.S. Appl. No. 13/980,465, filed Jul. 18, 2013, Blech.

* cited by examiner

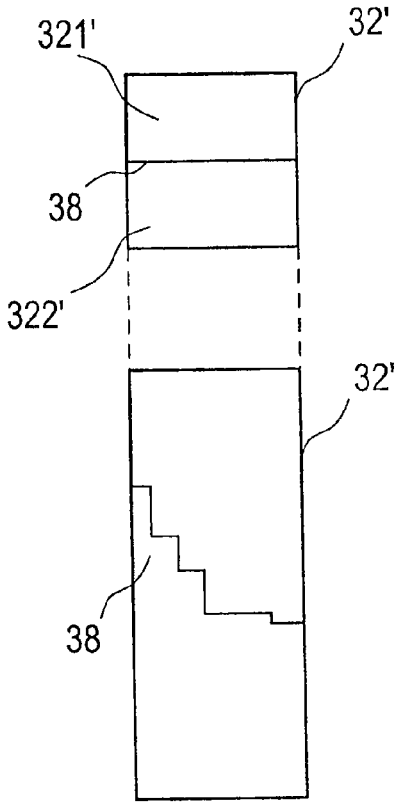
Fig. 4A
Fig. 4B
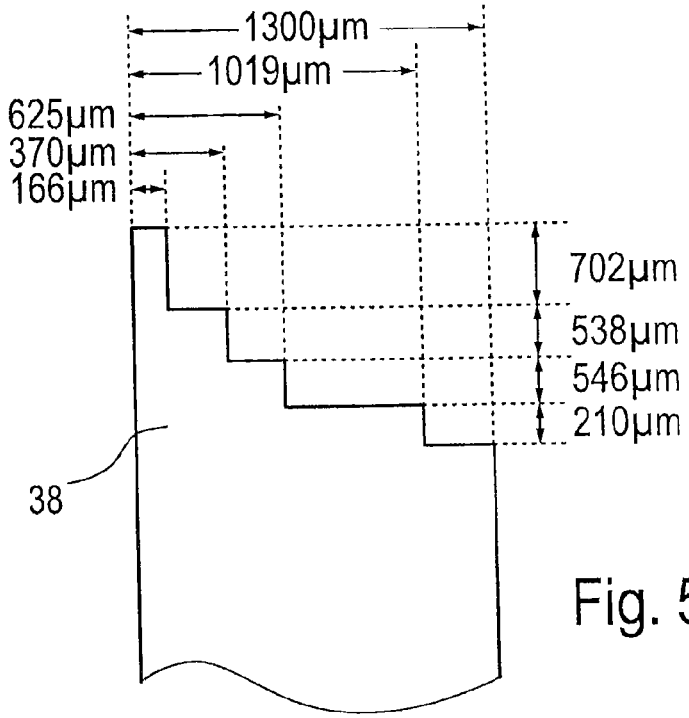
Fig. 5

MICROWAVE ANTENNA INCLUDING AN ANTENNA ARRAY INCLUDING A PLURALITY OF ANTENNA ELEMENTS

CROSS-REFERENCE TO RELATED APPLICATION

The present application claims the benefit of the earlier filing date of EP 11194773.5 filed in the European Patent Office on Dec. 21, 2011, the entire content of which application is incorporated herein by reference.

BACKGROUND

1. Field of the Disclosure

The present invention relates to a microwave antenna. Further, the present invention relates to an antenna array, in particular for use in such a microwave antenna, and to a antenna element, in particular for use in such a antenna array.

2. Description of Related Art

In millimeter wave imaging systems a scene is scanned in order to obtain an image of the scene. In many imaging systems the antenna is mechanically moved to scan over the scene. However, electronic scanning, i.e. electronically moving the radiation beam or the sensitivity profile of the antenna, is preferred as it is more rapid and no deterioration of the antenna occurs like in a mechanic scanning system.

In modern radar imaging two-dimensional (2D) MIMO beamforming topologies are used, which synthesize equidistantly spaced virtual two-way aperture distributions. Actually, the virtual aperture distribution is a two-dimensional convolution of the phase centers of the transmit (TX) and receive (RX) antenna phase centers. Most of the practically relevant array structures comprise 2D TX or RX antenna blocks. The present invention relates not only to such 2D MIMO beamforming antennas, but generally to any 2D antennas having a (sparse or non-sparse) array of antenna elements.

The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present invention.

SUMMARY

It is an object of the present invention to provide a microwave antenna in which the antenna elements can be arranged as compact as possible and which provides the ability to obtain more information out of a radar image. It is a further object of the present invention to provide a corresponding antenna element for use in such a microwave antenna.

According to an aspect of the present invention there is provided microwave antenna comprising an antenna array comprising a plurality of antenna elements, an antenna element comprising:

a cover, a hollow waveguide formed within the cover for guiding microwave radiation at an operating frequency between a first open end portion and a second end portion arranged opposite the first end portion, a septum arranged centrally and along the longitudinal direction within the waveguide and separating said waveguide into two waveguide portions, a substrate arrangement arranged at the second end portion within the cover, said substrate arrangement comprising a ground plane and line structures arranged on both sides of and at a distance from said ground plane and a substrate integrated waveguide, a waveguide transition arranged between said hollow waveguide and said substrate integrated waveguide, an integrated circuit arranged within said cover and being electrically contacted to said ground plane and said line structures, and terminals being electrically contacted to said integrated circuit.

According to a further aspect of the present invention there is provided an antenna element, in particular for use in such an antenna array, comprising a plurality of antenna elements, an antenna element comprising:

a cover, a hollow waveguide formed within the cover for guiding microwave radiation at an operating frequency between a first open end portion and a second end portion arranged opposite the first end portion, a septum arranged centrally and along the longitudinal direction within the waveguide and separating said waveguide into two waveguide portions, a substrate arrangement arranged at the second end portion within the cover, said substrate arrangement comprising a ground plane and line structures arranged on both sides of and at a distance from said ground plane and a substrate integrated waveguide, a waveguide transition arranged between said hollow waveguide and said substrate integrated waveguide, an integrated circuit arranged within said cover and being electrically contacted to said ground plane and said line structures, and terminals being electrically contacted to said integrated circuit.

Preferred embodiments of the invention are defined in the dependent claims. It shall be understood that the claimed antenna element has similar and/or identical preferred embodiments as the claimed microwave antenna and as defined in the dependent claims.

To gain the most information out of a radar image, polarimetry can be employed. Targets converting the polarization during scattering or being invisible for a solely linear polarized radar system can be detected. By evaluating the way the target is scattering, a more detailed picture can be obtained showing some of the scattering properties of the observed targets (e.g. rough surface, lattice, parallel wires, . . . ). Thus, by use of the present invention it is possible to obtain more information out of a radar image than e.g. with a single linear polarization.

In order to apply polarimetric picture processing, the transmit (TX) and receive (RX) antennas emit and receive the electromagnetic field in a dual-polarized manner, i.e. dual-polarized elements with orthogonal polarization is used. Orthogonal polarizations can either be linear vertical and linear horizontal (or linear in any orientation and the perpendicular polarization), left-hand circular and right-hand circular, or elliptically orthogonal (left-hand elliptical and right-hand elliptical with orthogonal orientation of the ellipse). The elliptical case is the most general case and can cover all aforementioned cases, which are special embodiments of the elliptical one.

Polarimetric evaluation of a radar image can be applied to any of the aforementioned orthogonal polarizations. In polarimetry they are even equivalent as by basis transformation the respective receive signals of either combination can be transformed to another by mathematical means.

In order to generate orthogonal polarized waves in a two-dimensional reflectarray antenna, the proposed antenna array and the proposed antenna comprising such an antenna array are configured such that the waveguides are divided into two waveguide portions by a septum. The septum converts a port signal fed at only one of the waveguide ports of one waveguide portion to a circularly (elliptically) polarized wave radiated from the waveguide including this waveguide portion.

Further, the problem related to the integration of the feed structure arising from any 2D antenna arrangement exhibiting dual-polarization has thus been overcome by the present invention. Due to geometrical reasons, the two feed structures of each element including a waveguide portion are realized in an inline configuration, which only offers the cross sectional space of the element aperture in z-direction. In other words, the proposed antenna elements each includes the required integrated circuitry, preferably realized as Monolithic Microwave Integrated Circuit (MMIC) integrated within the cover and only connected to the outside by terminals. The terminals are preferably on a low intermediate frequency (IF) or DC.

It shall be understood that according to the present invention the antenna may be used generally in the frequency range of millimeter waves and microwaves, i.e. in at least a frequency range from 1 GHz to 3 THz. The "operating frequency" may generally be any frequency within this frequency range. When using the term "microwave" herein any electromagnetic radiation within this frequency range shall be understood.

It is to be understood that both the foregoing general description of the invention and the following detailed description are exemplary, but are not restrictive of the invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 4A and 4B show different views of a waveguide including a septum as used in an antenna according to the present invention, FIG. 5 shows a top view of a septum.

DESCRIPTION OF THE EMBODIMENTS

Figure 1A:
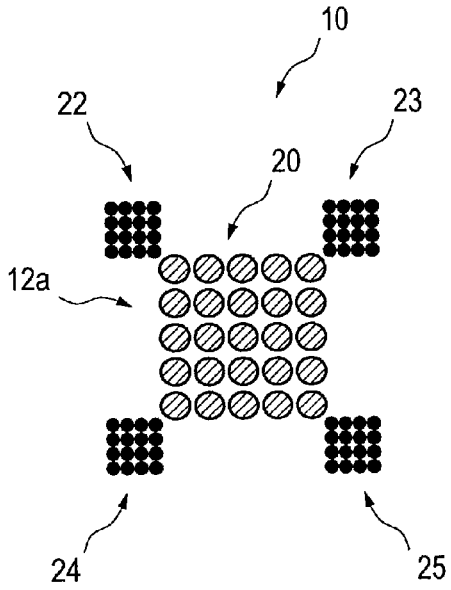
FIGS. 1A and 1B show an embodiment of an antenna array according to the present invention.
Figure 1B:
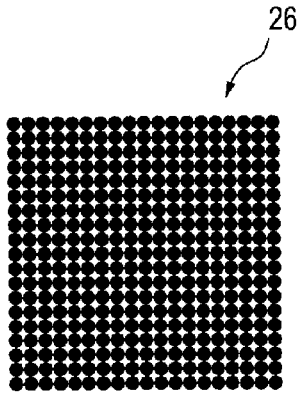

Referring now to the drawings, wherein like reference numerals designate identical or corresponding parts throughout the several views, FIG. 1A shows a general embodiment of a microwave antenna 10 according to the present invention. The antenna 10 comprises an antenna array 12*a* including a plurality of antenna elements 18. Such an antenna array may be used as a beamforming antenna array. For a certain steering angle each antenna signal has a certain time delay, which can be regarded as a phase shift in the narrowband case. So, phasing the antenna elements is used for beam scanning. In addition, amplitude weights can be applied to reduce the sidelobe levels. In radar imaging either fully populated 2D antenna arrays (element spacing $<\lambda/2$) or sparse 2D MIMO beamforming topologies are used, which synthesize equidistantly spaced virtual two-way aperture distributions. The antenna array 12*a* shown in FIG. 1A comprises a two-dimensional array 20 of receive antennas and four arrays 22, 23, 24, 25 of transmit antennas arranged in the corner areas of the array 20 of receive antennas. The qualitative virtual aperture distribution 26 (as shown in FIG. 1B) of this antenna array 12*a* is the 2D convolution of the phase centers of the transmit and receive antenna phase centers. Due to reciprocity of the antenna elements, RX and TX can be exchanged.

Generally, in order to realize a dual-polarized antenna element for a 2D antenna array, either two feeds for orthogonal linear polarizations must be realized or two feeds for left- and right hand circular polarizations must be integrated. The orthogonal linear case is realized in most cases by two orthogonal pins connected to a feed line coming from outside the cross section of the waveguide. Due to the large physical dimensions such a conventional solution can only be applied for a single antenna, but not for an element in 2D arrays, where the elements are densely packed. The present invention now provides a solution for exciting two orthogonal (linear or circular) polarizations by an inline feed structure which is generally rather complicated and not known so far.

Figure 2:
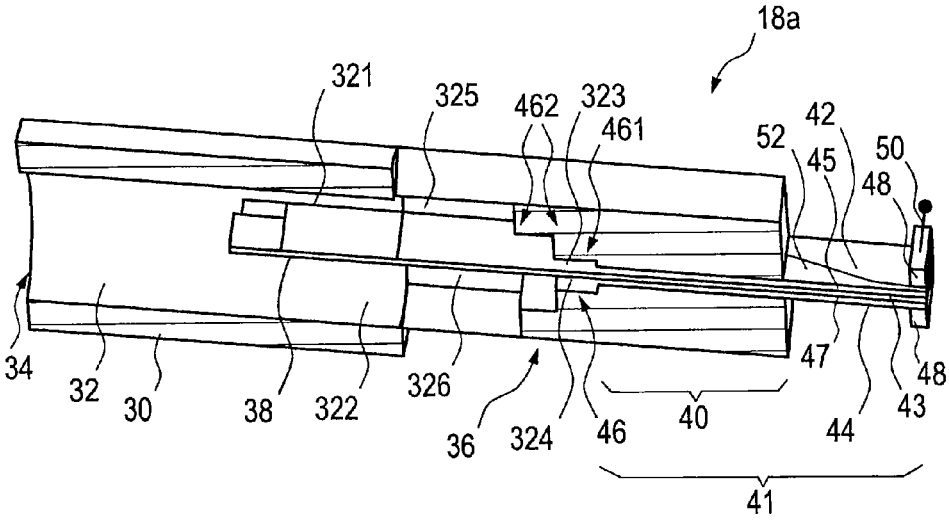
FIG. 2 shows a cross sectional perspective view of a first embodiment of a single antenna element according to the present invention.
Figure 3A:
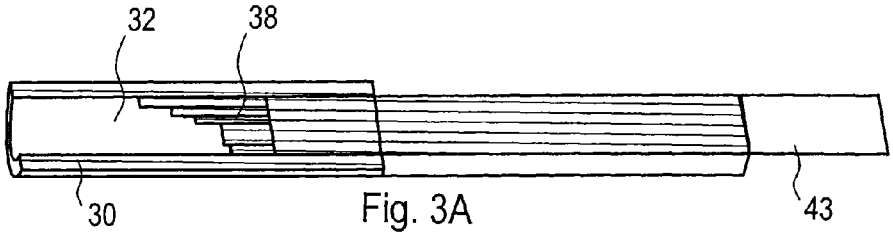
FIGS. 3A-3D show several cross sectional views of said first embodiment of the single antenna element.
Figure 3B:
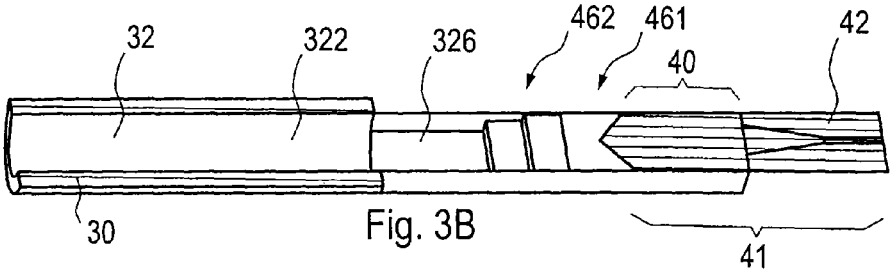
Figure 3C:
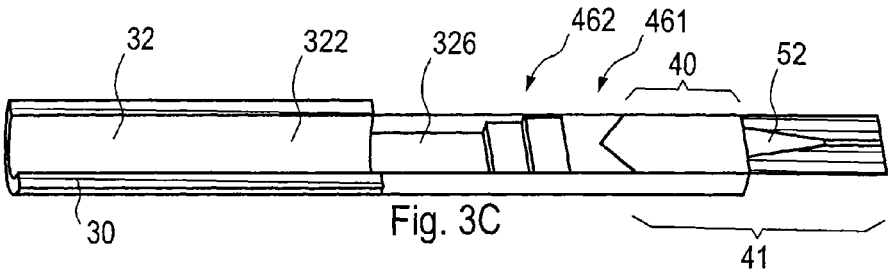
Figure 3D:
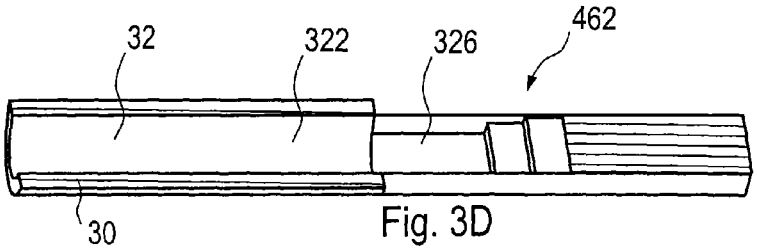

A first embodiment of a single antenna element 18*a* is depicted in FIG. 2 in a cross sectional perspective view. Several cross sectional views of said first embodiment of the single antenna element 18*a* are shown in FIGS. 3A-3D. The antenna element 18*a* comprises a cover 30, within which a hollow waveguide 32 is formed for guiding microwave radiation at an operating frequency between a first open end portion 34 and a second end portion 36 arranged opposite the first end portion 34. A septum 38 is arranged centrally and along the longitudinal direction within the waveguide 32 that separates said waveguide 32 into two waveguide portions 321, 322. Further, a substrate arrangement 41 is arranged at the second end portion 36 within the cover 30, said substrate arrangement 41 comprising a ground plane 43 and line structures 42, 44 arranged on both sides of and at a distance from said ground plane 43 and a substrate integrated waveguide 40 (also comprising the ground plane 43). The ground plane 43 and the septum 38 may generally be separate elements, but in preferred embodiments the septum includes or corresponds to said ground plane 43 and particularly represents the front end section of said ground plane 43. Further, between the ground plane 43 and the line structures a substrate layer, e.g. Teflon, Ceramic or LCP (liquid crystal polymer), is preferably arranged.

A waveguide transition 46 arranged between said hollow waveguide 32 and said substrate integrated waveguide 40. Still further, an integrated circuit 48 is arranged within said cover 30 on both sides of said ground plane 43 and is electrically contacted to said ground plane 43 and said line structures 42, 44. Finally, terminals 50 that are electrically contacted to said integrated circuit 48 are arranged on the back side of the substrate arrangement 41 (or the back portion of the cover, if there is part of the cover arranged on the back side of the substrate). The antenna elements are inline configurations, in which the circuitry is arranged only in z-direction on the cross sectional area of the element's aperture.

Preferably, this embodiment is able to generate two orthogonal polarizations by an inline feed is through the usage of left and right hand circular (elliptical) polarization. This can be done in a simpler manner compared to the linear case. Therefore a cascaded structure of transitions is preferably used as also depicted in FIGS. 2 and 3.

In preferred embodiments the integrated circuit(s) is (are) employed as MMIC(s) (Monolithic Microwave Integrated Circuit(s)) 48 that are attached to the top and/or the bottom side of one or two thin substrate(s) 45, 47, which share one common ground plane 43, in particular the septum 38, in the center. The substrate arrangement (also called multilayer substrate) contains a line structure 42, 44, 43 like e.g. microstrip line or coplanar waveguide, which guides the signal from the MMIC(s) 48 to the stripline transition 52. This stripline transition 52 transforms the quasi transversal electro-magnetic (TEM) mode into a $TE_{10}$ mode in the substrate integrated waveguide (SIW) 40 realized on the same substrate.

The SIW 40 ends in the waveguide transition 46 comprising a launcher unit 461 providing a transition from said SIW 40 into first hollow waveguide portions 322, 324. Preferably, the launcher unit 461 has a triangular shape. This launcher unit 461 thus represents a transition from the SIW 40, which is preferably filled with dielectric, into a hollow waveguide of the same dimension preferably filled with air.

As the height of this waveguide, i.e. the first waveguide portions 323, 324, is relatively narrow (much narrower than the typically used quarter wavelength of a rectangular waveguide), another transition, in particular a matching unit 462, is provided to match the thin waveguide to a rectangular waveguide, i.e. second hollow waveguide portions having a larger width and/or height than said first hollow waveguide portions 325, 326, in particular having a width of a half wavelength and a height of a quarter wavelength. The matching unit 462 can have 1 . . . n steps. Alternatively it can have a continuous profile, e.g. a linear taper. The waveguide portions 321 and 322 can have a rectangular (side ratio 2:1) or a half-circular cross section. Further, in an embodiment the waveguide portions 321 and 325 as well as 322 and 326 can be put together directly or that there could be a smooth transition, which matches the rectangular cross section of the waveguide portion 325 and 326, respectively, to the half-circular cross-section of the waveguide portion 321 and 322, respectively.

Figure 6:
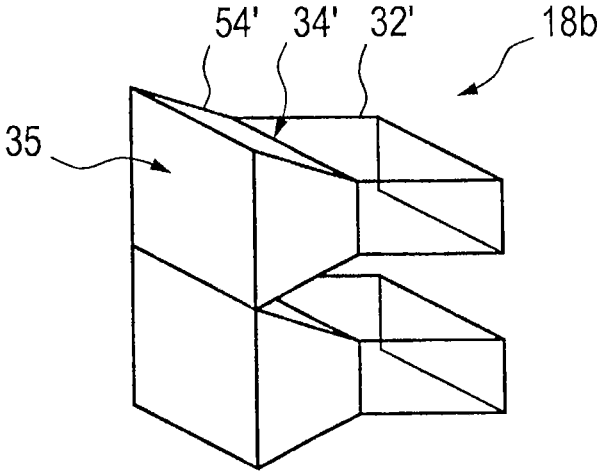
FIG. 6 shows a perspective view of a second embodiment of a single antenna element according to the present invention.

Preferably, as shown in FIGS. 2 and 3 the described elements are provided for pairs of waveguides, whose structures are symmetrical to the ground plane 43 (which is preferably the rear part of the septum 38) of the substrate arrangement 41. This basic building block can then be extended to form an open-ended waveguide 32 of quadratic or circular cross section. Therefore the ground plane 43 is modified to exhibit the shape of the septum 38 at the front part extending into the waveguide 32. The qualitative shape of the septum 38 is depicted in FIGS. 5 and 6.

FIG. 4A shows a front view and FIG. 4B shows a cross sectional view of a waveguide 32' of an antenna element 18*a* according to the present invention. As shown in this embodiment the aperture (FIG. 4A) is made up of quadratic open-ended waveguide 32'. Each of the quadratic waveguides 32' is divided into two rectangular waveguide portions 321', 322' by the septum 38.

Preferably, the waveguide portions 321', 322' have a rectangular cross-section having a width w (between the left and right sidewalls) of substantially a half wavelength ($0.5\lambda<w<0.9\lambda$) and a height h (between the upper and lower sidewalls) of substantially a quarter wavelength ($0.25\lambda<h<0.45\lambda$) of the microwave radiation of the operating frequency. By use of such a dimensioning of the waveguide it is made sure that only the fundamental $TE_{10}$ mode of the microwaves is guided through the waveguide. Further, since only the fundamental $TE_{10}$ mode can propagate within the waveguide, it can be assured that the radiation pattern always looks the same, The septum 38 converts a port signal fed at only one of the virtual rectangular waveguide ports (of a single waveguide portion) to a circularly (elliptically) polarized wave radiated from the quadratic open ended waveguide 32'. In other words, the function of the septum 38 is to generate a circularly polarized wave by feeding one of the rectangular waveguide portions 321', 322'. In case both rectangular waveguide portions 321', 322' are fed at the same time, linear polarization can be generated as well. All technically relevant combinations of feeding the antenna element 18*a* are summarized in the following table when feeding the quadratic waveguide by either of the rectangular waveguides or both rectangular waveguides at the same time. The septum 38 can either be located in between two rectangular or two half-circular waveguides.

| Port 1 phase | Port 2 phase | Resulting polarization |
|---|---|---|
| X | — | Left hand circular |
| — | X | Right hand circular |
| X | X | Linear vertical |
| X | X + 180° | Linear horizontal |

Exemplary dimensions of the septum 38 are given in FIG. 5 for an operating frequency of 140 GHz. For instance, the septum 38 has a thickness of 50 μm and the number of sections (steps) is between 3 and 10, typically 5 or 6. The dimensions of the septum can vary and are normally determined by numerical electromagnetic field simulations.

Optionally, there is another transition provided between the rectangular waveguides and the circular cross section. They can either be directly connected to each other or a smoothly shaped longer section can be used in between. Once the circular polarized wave is generated in the quadratic or circular waveguide a pyramidal, conical or corrugated horn can be attached to it to generate a more focused beam as shown in the embodiment of the antenna element 18*b* shown in FIG. 6 (showing two of such antenna elements 18*b*). In this embodiment an aperture element 54, for instance a symmetric quadratic pyramidal aperture, is arranged in front of the first end portion 34' of the waveguide 32' having a larger aperture 35 than the first end portion 34' of the waveguide 32'. In this embodiment the aperture element 54 is a horn that preferably has a quadratic aperture. Further, the horn as well as the waveguide preferably have a quadratic cross section.

By operating port 1 and 2 at the same time, linear polarizations can be generated as well. If port 1 and 2 are excited with the same phase, vertical polarization will result. If port 1 and 2 are excited with 180° phase shift, horizontal polarization is generated. As any antenna is reciprocal, the same holds for the receive mode.

In case the scene is scanned with left and right hand circular polarization, both orthogonally polarized RX signals can be acquired at the same time and real polarimetric evaluation is possible. This means all four parameters of the polarimetric scattering matrix can be determined. In case the antenna elements are operated in linear polarization mode, two subsequent measurements must be carried out to determine the copolarized response of a scene in both linear polarizations. In this mode not all parameters of the polarimetric scattering matrix can be determined. Assuming the scene is quasi-static for the period of the scan, any slow movement will not affect the resulting picture significantly.

Figure 7A:
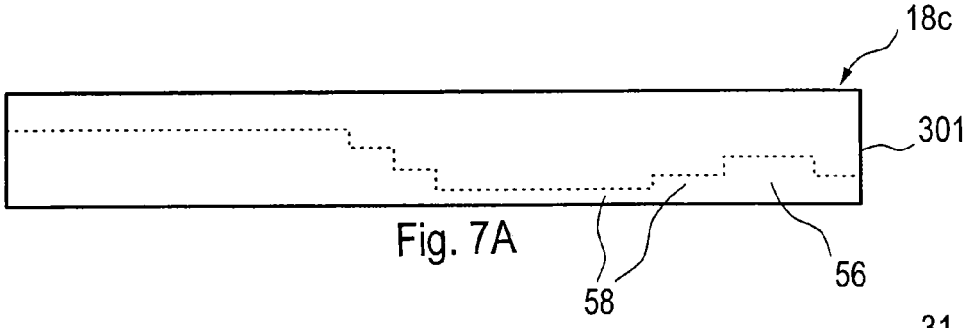
FIGS. 7A-7C show an explosive view of a third embodiment of a single antenna element according to the present invention.
Figure 7B:
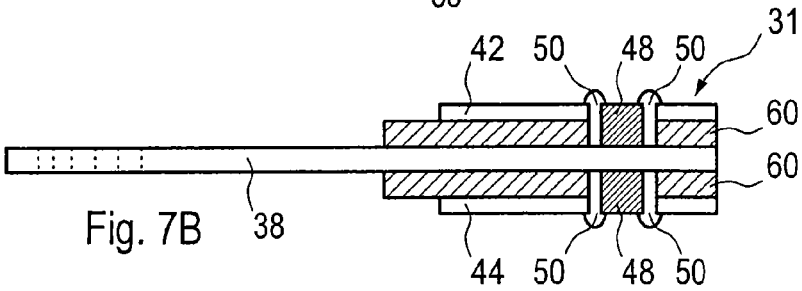
Figure 7C:
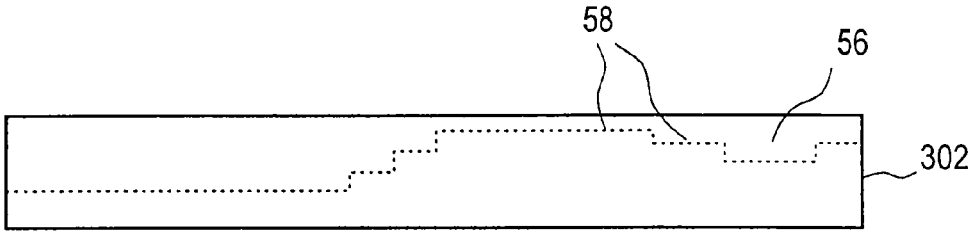

FIG. 7A-7C show an explosive view of a third embodiment of a single antenna element 18*c* according to the present invention. In such a practical realization of the antenna each antenna element 18*c* is made of three components, in particular a top cover 301, which is part of a split-block, a center inlay 31 comprising a multi-layer substrate with three metal layers 38, 42, 44, and a bottom cover 302, which is the counterpart of the split-block housing.

It can be seen from FIG. 7B that also the MMICs 48 which incorporate the TX and/or RX functionality can be easily integrated into the setup. Therefore, cavities 56 are included in the top and bottom cover 301, 302. Further, channels 58 are provided for the microstrip lines 42, 44 (separated from the septum 38 by dielectric layers 60) and the IF and DC lines. The MMICs 48 can be interfaced on a low IF frequency and for DC biasing from the back side of the inline structure 31 via terminals 50 (in particular bond wires or soldered wires). For this purpose a standard multi-layer PCB can be bonded or soldered to the respective lines, which contains all the signal conditioning.

Figure 8A:
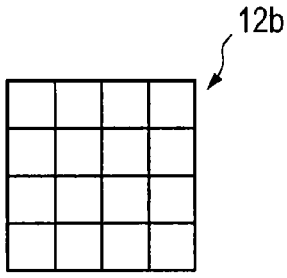
FIGS. 8A-8E show further embodiments of an antenna array according to the present invention.
Figure 8B:
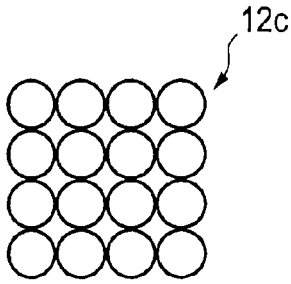
Figure 8C:
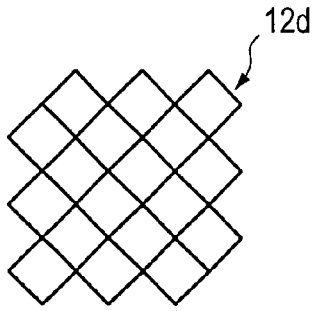
Figure 8D:
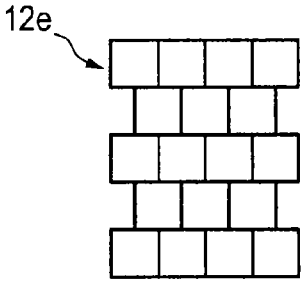
Figure 8E:
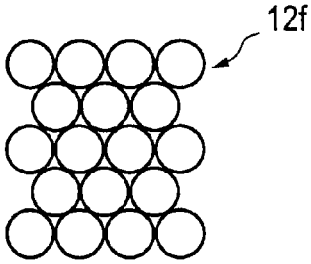

The arrangement is not limited to square or circular apertures. There can even be diamond or honeycomb like aperture distributions of the antenna array. A summary of potential arrangements is shown in FIGS. 8A-8E. FIG. 8A shows an antenna array 12*b* having quadratic apertures in a rectangular arrangement, FIG. 8B shows an antenna array 12*c* having circular apertures in a rectangular arrangement, FIG. 8C shows an antenna array 12*d* having diamond apertures in a rectangular arrangement, FIG. 8D shows an antenna array 12*e* having quadratic apertures in a honeycomb arrangement, and FIG. 8E shows an antenna array 12*f* having circular apertures in a honeycomb arrangement.

In summary, the presented dual-polarized antenna structure enables polarimetric measurements with 2D antenna arrays. This applies to conventional 2D antenna arrays as well as for 2D MIMO arrays. The antenna elements can be densely packed to avoid grating lobes (aliasing in the antenna pattern). The capability to densely integrate the antenna elements (in terms of spacing given in a fraction of a wavelength) is especially important in millimeter wave systems. The entire RF frontend can be integrated and packaged in a building block, realized in split-block technology, incorporating the dual-polarized antenna and two independent TX/RX or TRX MMICs.

The invention can be applied in various devices and systems, i.e. there are various devices and systems which may employ an antenna, an antenna array and/or an antenna element as proposed according to the present invention. The frequency range can be from 1 GHz to 3 THz depending on the size and the number of antenna elements the antenna array should have. Potential applications include—but are not limited to—a passive imaging sensor (radiometer), a radiometer with an illuminator (transmitter) illuminating the scene to be scanned, and a radar (active sensor). Further, the present invention may be used in a communications device and/or system, e.g. for point to point radio links, a base station or access point for multiple users (wherein the beam can be steered to each user sequentially or multiple beams can be generated at the same time, interferers can be cancelled out by steering a null to their direction), or a sensor network for communication among the individual devices. Still further, the invention can be used in devices and systems for location and tracking, in which case multiple plasmonic antennas (at least two of them) should be employed at different positions in a room; the target position can then be determined by a cross bearing; the target can be an active or passive RFID tag)

Obviously, numerous modifications and variations of the present disclosure are possible in light of the above teachings. It is therefore to be understood that within the scope of the appended claims, the invention may be practiced otherwise than as specifically described herein. In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

The invention claimed is:

1. A microwave antenna comprising an antenna array comprising a plurality of antenna elements, an antenna element comprising:

a cover;

a hollow waveguide formed within the cover for guiding microwave radiation at an operating frequency between a first open end portion and a second end portion arranged opposite the first end portion;

a septum arranged centrally and along the longitudinal direction within the waveguide and separating said waveguide into two waveguide portions;

a substrate arrangement arranged at the second end portion within the cover, said substrate arrangement comprising a ground plane and line structures arranged on both sides of and at a distance from said ground plane and a substrate integrated waveguide;

a waveguide transition arranged between said hollow waveguide and said substrate integrated waveguide;

an integrated circuit arranged within said cover and being electrically contacted to said ground plane and said line structures; and terminals being electrically contacted to said integrated circuit.

2. The microwave antenna as claimed in claim 1, wherein said waveguide has a quadratic cross section and said septum is arranged to separate said waveguide into said waveguide portions each having a rectangular cross section.

3. The microwave antenna as claimed in claim 1, wherein said waveguide has a circular or elliptical cross section and said septum is arranged to separate said waveguide into said waveguide portions each having a semi-circular or semi-elliptical cross section.

4. The microwave antenna as claimed in claim 1, wherein said septum comprises a step profile facing into the direction of the first end portion of the waveguide.

5. The microwave antenna as claimed in claim 4, wherein said septum comprises a step profile having a number of steps in the range from 3 to 10.

6. The microwave antenna as claimed in claim 1, wherein said substrate arrangement comprises microstrip lines as line structures or a grounded coplanar waveguide.

7. The microwave antenna as claimed in claim 1, wherein said waveguide transition comprises a launcher unit providing a transition from said substrate integrated waveguide into first hollow waveguide portions and a matching unit providing a transition from each of said first hollow waveguide portions into second hollow waveguide portions having a larger width and/or height than said first hollow waveguide portions.

8. The microwave antenna as claimed in claim 1, further comprising a stripline transition arranged between said integrated circuit and said substrate integrated waveguide.

9. The microwave antenna as claimed in claim 2, wherein each waveguide portion has a rectangular cross section having a width in the range from 50% to 90% of the wavelength and a height in the range from 25% to 40% of the wavelength of the microwave radiation of the operating frequency.

10. The microwave antenna as claimed in claim 1, wherein said cover is split into a top cover and a back cover coupled together, wherein said top cover and said back cover comprises cavities for arranging said integrated circuit through said cover.

11. The microwave antenna as claimed in claim 1, wherein said antenna element further comprises an aperture element arranged in front of the first end portion of the waveguide and having a larger aperture than the first end portion.

12. The microwave antenna as claimed in claim 1, wherein said septum is part of said ground plane.

13. An antenna element comprising:

a cover;

a hollow waveguide formed within the cover for guiding microwave radiation at an operating frequency between a first open end portion and a second end portion arranged opposite the first end portion;

a septum arranged centrally and along the longitudinal direction within the waveguide and separating said waveguide into two waveguide portions;

a substrate arrangement arranged at the second end portion within the cover, said substrate arrangement comprising a ground plane and line structures arranged on both sides of and at a distance from said ground plane and a substrate integrated waveguide;

a waveguide transition arranged between said hollow waveguide and said substrate integrated waveguide;

an integrated circuit arranged within said cover and being electrically contacted to said ground plane and said line structures; and terminals being electrically contacted to said integrated circuit.

* * * * *